US005083420A

United States Patent [19]

Rupert et al.

[11] Patent Number: 5,083,420

[45] Date of Patent: Jan. 28, 1992

[54] PROCESS AND DEVICE TO PIECE A YARN ON AN OPEN-END SPINNING DEVICE

[75] Inventors: Karl Rupert; Becker Rudolf, both of Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 533,475

[22] Filed: Jun. 5, 1990

[30] Foreign Application Priority Data

Jun. 9, 1989 [DE] Fed. Rep. of Germany ..... 3918946

[51] Int. Cl.[5] ..... D01H 15/00

[52] U.S. Cl. ..... 57/263; 57/352; 57/405

[58] Field of Search ..... 57/263, 301, 302, 304, 57/305, 400, 405, 406, 417, 352, 353

[56] References Cited

U.S. PATENT DOCUMENTS

| | | | |
|---|---|---|---|
| 3,924,393 | 12/1975 | Stahlecker et al. | 57/263 |
| 3,962,855 | 6/1976 | Stahlecker | 57/417 X |
| 4,145,867 | 3/1979 | Kamp | 57/263 |
| 4,438,624 | 3/1984 | Mayer et al. | 57/263 X |
| 4,494,371 | 1/1985 | Morita et al. | 57/263 |
| 4,644,742 | 2/1987 | Loyas et al. | 57/263 |
| 4,724,665 | 2/1988 | Raasch et al. | 57/305 X |

FOREIGN PATENT DOCUMENTS 3417331 11/1984 Fed. Rep. of Germany .

*Primary Examiner*—Daniel P. Stodola
*Assistant Examiner*—William T. Stryjewski
*Attorney, Agent, or Firm*—Dority & Manning

[57] ABSTRACT

In a device for the piecing of a yarn on an open-end spinning device, a yarn mover by means of which a yarn end is fed to a yarn draw-off pipe is provided. A first stop to determine the cutting position and a second stop to determine the yarn insertion position are assigned to the yarn mover. The first stop can be put out of action. In addition, a yarn length adjusting device is provided to determine the length of yarn to be fed back into the open-end spinning element. The cutting position and the yarn insertion position of the yarn mover are set for the smallest size fiber collection surface of the open-end spinning element that can be used. When larger fiber collection surfaces are used, the additional required length of yarn is readied by rotating the winding device backward.

27 Claims, 7 Drawing Sheets

PROCESS AND DEVICE TO PIECE A YARN ON AN OPEN-END SPINNING DEVICE

BACKGROUND OF THE INVENTION

The instant invention relates to a device to piece a yarn on an open-end spinning device, having a open-end spinning element, a yarn draw-off pipe, a winding device, a feeding device to feed a yarn end to the yarn draw-off pipe, a cutting device to cut the yarn to a defined length and with a drive arrangement to move the feeding device from a rest position via a yarn receiving position and a cutting position above the yarn draw-off pipe and beyond into a yarn insertion position, as well as a process for piecing a yarn by means of such a device.

In a known device, (German Patent No. DE 3,417,331 A1) for the piecing of a yarn, the yarn mover as well as the cutting device can be moved from a rest position so as to receive the yarn, to cut it to size, to present it to the yarn draw-off pipe and finally to release it. The yarn mover and the cutting device are movably mounted on a carriage, and are driven at set translation ratios by one and the same drive installed on the carriage.

In practice, when different materials are to be spun, the spinning rotor is often replaced by one with a different diameter. If the yarn back-feeding length is not adapted to the different diameter of the spinning rotor (or to the size of another open-end spinning element), there is a danger that the piecing operation will fail or that the piecing joint may not lie within established tolerances. Setting the yarn back-feeding length is, however, not possible with the known device, as either the cutting of the yarn would not be ensured or the cutting device could come into the area of the yarn draw-off pipe.

SUMMARY OF THE INVENTION

It is, therefore, the object of the instant invention to provide a device made in such a manner that the back-fed yarn length can be adapted to whatever open-end spinning element is being used and a process that can be carried out by means of this device.

This object is attained through the invention in that a first stop is provided to determine the cutting position and a second stop is provided to determine the yarn insertion position and are assigned to the yarn mover. It is possible to take the first stop out of action, and a yarn length adjustment device is provided to determine the yarn length to be fed back into the open-end spinning element. The first of the two stops determines the yarn length protruding from the yarn mover in the form of a free yarn end, while the second stop adjusts the distance between the yarn mover and the outlet of the yarn draw-off pipe in such manner that, depending upon the length of the free yarn end, the latter is brought exactly to a point above the outlet of the yarn draw-off pipe. This fixing of the yarn mover's cutting position and yarn insertion position makes it possible to set precise yarn lengths so that the required, precise yarn length needed for piecing can be set by means of the yarn length adjusting device.

In order to be able to pre-set with precision the yarn length to be fed back, the yarn length adjusting device is preferably equipped with an adjusting scale. The scale is preferably provided with markings for the different sizes of the open-end spinning elements. It has been found that the yarn length to be fed back must also be of different lengths as a function of the different types of fibers used, and for that reason it is also advantageous for the adjusting scale to be provided with markings for the different fiber types.

The yarn length adjusting device can be designed in different ways in order to control the yarn length to be fed back in different manners. In a preferred embodiment the first of the two stops is adjustable and is part of the yarn length adjusting device. Thereby, a length of the yarn appropriate for the desired yarn back-feeding is produced. When the second stop is non-adjustable, an appropriate design of the outlet of the yarn draw-off pipe or appropriate air guidance can, nevertheless, ensure reliable aspiration of the yarn end, even with different yarn end lengths and an identical distance over which the yarn mover is moved to a location above the outlet of the yarn draw-off pipe.

The two stops are installed on a common holding device to adjust not only one stop by moving it in relation to the holding device, but to set both stops together by adjusting the common holding device.

In order to avoid having to adapt the feeding movement of the yarn mover to the applicable position of the second stop, the yarn mover is connected to its drive arrangement via an elastic or resilient coupling link. When the yarn mover is stopped as it runs up against the second stop, the additional movement of the drive is taken up by this elastic coupling link.

It is not absolutely necessary for the stops to be adjustable. Instead, or in addition to stop adjustability, the yarn length adjustment device can also be connected via a control device to the drive arrangement of a yarn back-feeding device which can be constituted by the winding device or by an auxiliary bobbin and its drive, or by auxiliary rollers. It is thus possible to feed yarn lengths which are not prepared through appropriate adjustment of the stops by means of an adapted back-feeding device from the bobbin device back into the spinning element.

The yarn mover can be mounted and moved in any desired manner, but the installation of the yarn mover on a pivot axis is especially advantageous, whereby the holding device is also located on the pivot axis of the yarn mover. In a preferred embodiment of the instant invention the pivot axis is essentially parallel to the path of the yarn, so that the yarn mover can be moved correspondingly in an essentially horizontal pivoting plane.

To make it possible for the yarn mover to be moved into position for the transfer of the yarn to the yarn draw-off pipe after it is cut to length, the first stop must release the yarn mover. This can be achieved in different ways, e.g., through a retractable counter-element on the yarn mover. It is advantageous for the first stop to be mobile perpendicular to the direction of movement of the yarn mover. In order to discharge this stop, it is possible to enable the yarn mover to be moved briefly by the first stop before it is retracted.

Normally the yarn is not only cut to a set length but is also given a particular shape which is especially well suited for piecing. In that case provisions are preferably made for a yarn end preparation device to be installed in the path of movement of the yarn mover, between the cutting device and the cutting position of the yarn mover.

In order to obtain the defined conditions in preparing the yarn end it has proved to be advantageous for a bearing curve to be connected to the first stop, against which bearing curve the preparation device bears resiliently and by means of which it can be brought within range of the yarn extending towards the yarn mover, which is in its cutting position. It is also advantageous for the preparation device to be mounted so as to be capable of pivoting around the cutting device.

In order to avoid having to provide excessively long covers for the draw-off pipe when the yarn mover is brought into different end positions as the yarn end is transferred to the draw-off pipe, it is advantageous for a draw-off pipe cover to be assigned to the yarn mover, whereby said cover is held against the trailing side of the yarn mover (in relation to the feeding movement of the yarn mover) by means of an elastic element and is held back within range of the yarn draw-off pipe in that position vis-a-vis the on-moving yarn mover. In this way it is possible to obtain an embodiment in which a compact draw-off pipe cover is provided which always stops above the draw-off pipe and optimizes the air guidance independently of the feeding movement of the yarn mover, so that secure aspiration of the yarn end is ensured independently of the given length of the yarn end and the corresponding feeding movement of the yarn mover.

In an advantageous embodiment the draw-off pipe cover is provided with a cover plate whose leading edge, (in relation to the feeding movement of the yarn mover) is made in form of a counter-stop for the stop in the area of the yarn draw-off pipe. It is possible to reinforce the air guidance in the area of the outlet of the yarn draw-off pipe by means of the cover plate, so that improved insertion of the yarn end into the draw-off pipe is achieved. In order to further improve this action it is advantageous for the draw-off pipe cover to be equipped with a bearing piece and a cover plate mounted on it in such manner as to be capable of pivoting and which can be brought to bear against the outlet of the yarn draw-off pipe. It has been proven advantageous to provide the cover plate with a controllable drive arrangement which is, preferably, equipped with a solenoid.

To be able to equalize dimensional tolerances and to achieve an optimal covering of the area of the outlet of the draw-off pipe in a simple manner it is advantageous for the cover plate to be provided with an elastic or elastically mounted sealing plate on its side towards the yarn draw-off pipe, the sealing plate being made in the form of a rigid sealing plate elastically supported by the cover plate in a preferred embodiment. In order to assure that it is the cover plate and not the sealing plate which serves as a stop the cover plate is designed so as to rise above the sealing plate in the direction of the yarn mover.

Especially where the yarn mover is mounted so as to be capable of pivoting it is advantageous for the draw-off pipe cover to be mounted, by its bearing part, together with the yarn mover in such manner as to be capable of pivoting on a common axis.

It is customary to carry out piecing with the help of a service unit which is capable of traveling alongside a plurality of adjoining open=end spinning devices. In that case, the yarn mover, its two stops as well as the yarn length adjustment device, are installed on the service unit.

In a preferred process the cutting position and the yarn insertion position of the yarn mover can be adjusted for a predetermined size of the fiber collection surface of the open-end spinning element and deviating yarn lengths are produced for piecing through back-feeding or drawing-off of the yarn. Here, the cutting position and the yarn insertion position of the yarn mover are adjusted for the smallest size of fiber collection surface of the open-end spinning element that may be used, and when larger sizes of the fiber collection surface are used the additional yarn length needed is made available through back-feeding. In this way the yarn back-feeding length can be controlled easily, e.g., by changing an electronic control program.

The device according to the invention, and also the process according to the invention, are simple and make it possible to set the yarn length to be fed back with great precision so that defined, unobtrusive piecing joints of great strength can be achieved. If spinning rotors are replaced in a machine by other spinning rotors of different diameters, or spinning elements are replaced by others with fiber collection surfaces of different size, it is possible to effect precise and rapid adaptation to the new diameter or to the new fiber collection surface size, so that the same piecing reliability as always is ensured and also so that the piecing joints are unobtrusive.

BRIEF DESCRIPTION OF THE DRAWINGS

Further details of the invention shall be described in greater detail hereinafter, through different embodiments with the help of drawings, in which.

DETAILED DESCRIPTION OF THE INVENTION

Figure 1:
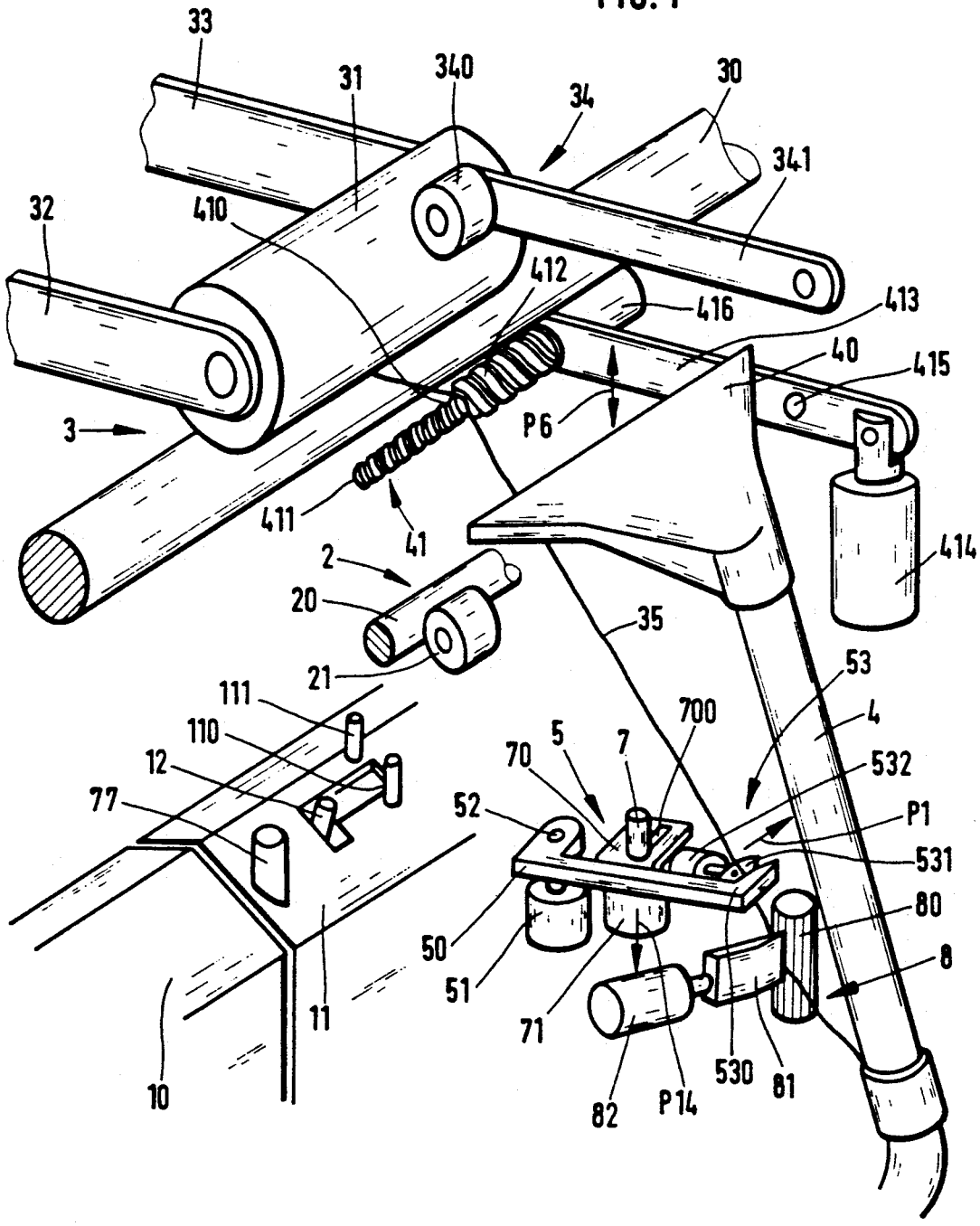
FIG. 1 is a perspective view of an open-end spinning station with the piecing device according to the invention.

The invention shall first be explained through FIG. 1 in which only those parts which are necessary to understand the invention are shown.

In an open-end spinning machine, a plurality of open-end spinning devices are installed next to each other, and of these, only the covers 10 and 11 of two adjoining spinning stations are shown in FIG. 1. The covers 10, 11 each cover a spinning device which is provided in the conventional, and therefore not shown, manner with an open-end spinning element, e.g., a spinning rotor with a fiber collection surface. The open-end spinning element is preceded by an opening device to which a fiber sliver is fed by means of a feeding device. The opening device opens the fiber sliver into individual fibers which are fed to the open-end spinning element and are there deposited under the action of a suction air stream (negative spinning pressure) on the fiber collection surface. The fibers are incorporated into the end of a yarn end and are drawn off through a yarn draw-off pipe 12 by means of a pair of draw-off rollers 2 consisting normally of a driven draw-off roller 20 and a pressure roller 21 pressing elastically against it. The drawn-off yarn 35 is fed to a winding device 3 which is provided with a driven winding roller 30 on which a bobbin 31 lies during the spinning operation. The bobbin 31 is borne, in a known manner, between two bobbin arms 32 and 33 by means of which the bobbin 31 is brought to bear against the winding roller 30 or can be lifted away from it.

The bobbin 31 can be assigned an auxiliary drive arrangement 34 equipped with an auxiliary drive drum 340 capable of being driven. Since such auxiliary drive arrangements are known, the conventional swivel drive for this as well as the drive arrangements for the auxiliary drive drum 340 are not shown for the sake of clarity in the drawing.

To be able to suck the yarn end which is produced by a yarn breakage away from the bobbin 31 when such a yarn breakage occurs, a suction pipe 4, which can be brought to the bobbin 31, is provided. Suction pipe 4 is provided with an outlet piece 40 in the usual manner, the outlet piece 40 extending, in the receiving position, near the bobbin 31 parallel to its circumferential line over the entire length of the bobbin 31. The suction pipe 4 is equipped with a longitudinal slit on its side towards the winding device 3 and the spinning device (of which only the cover 11 can be seen) through which the yarn 35 can emerge from the suction pipe 4 when the latter is pivoted back into the position shown in FIG. 1.

A centering device 41 is located in the path of the yarn 35 emerging from the suction pipe 4. In the embodiment shown, device 41 consists of a driven spindle with two length segments 410 and 411 with different diameters between which a circumferential groove 412 is located. The centering device 41 is mounted on a pivot arm 413 capable of being brought around a pivot axis 415 into different positions by a pivot drive 414.

The length segment 410 towards the pivot arm 413 has a larger diameter than the length segment 411 at the free end of the centering device 41. In addition, the two length segments 410 and 411 are provided with threads going in opposite directions. The centering device 41 can be driven selectively in either of the two directions of rotation by means of a drive 416.

The yarn 35 extending from the suction pipe 4 via the centering device 41 to the bobbin 31 can be assigned a yarn mover 5. The yarn mover 5 consists essentially of a pivot arm 50 which can be pivoted around its pivot axis 52 by means of a pivot drive 51. At its free end, away from the axis 52, the yarn mover 5 is equipped with a controllable yarn clamp 53 according to FIG. 1, consisting of a clamping jaw 530 rigidly connected to the pivot arm 50 and of a clamping jaw 531 which can be moved towards it. This clamping jaw 531 is assigned a drive 532, e.g., in the form of a solenoid.

The yarn mover 5 is assigned a stop 7. This stop 7 is mounted on a holding device 70 which is borne by the anchor of a solenoid 71 and is moved by same into the pivoting range of the yarn mover 5 or is moved out of it and is thus put out of action (see arrow P14). The holding device 70 is provided with an adjusting slot 700 by means of which the stop can be adjusted essentially parallel to the pivoting path of the yarn mover 5 (arrow P1).

An additional stop 77, which is installed on the cover 11 and cannot be adjusted in the embodiment shown in FIG. 1, is assigned to the yarn mover 5. As shall be explained later in further detail, stop 77 determines the yarn insertion position of the yarn mover 5. Yarn insertion position is to be understood to mean the position of the yarn mover 5 when the end of yarn 35 is located above the outlet of the yarn draw-off pipe 12 and can be inserted into it.

A cutting device 8 is provided in the path of the yarn, between the end of the longitudinal slit of the suction pipe 4 away from the bobbin 31 and the centering device 41, in such a manner that a yarn 35 can be cut on the side of the yarn clamp 53 away from the bobbin 31. According to the embodiment shown in FIG. 1, the cutting device 8 consists of a roller 80 which serves as an anvil and with which a cutting edge 81, which is provided with a drive 82 for that purpose, interacts. For the sake of clarity the cutting device 8 has ben shown in FIG. 1 as being somewhat turned away from the correct position shown in FIG. 2.

As appears from FIG. 1, the cutting position of the yarn mover 5 is determined by the above-mentioned stop 7. The cutting position is to be understood to be the position of the yarn mover 5 when the yarn end extending into the suction pipe 4 is cut from the yarn 35 connected to the bobbin 31. The stop 7, which can be displaced in the direction of arrow Pl or in the opposite direction, thus determines the length of the yarn end produced by means of the cutting device 8 that protrudes from the yarn clamp 53. If the angular distance (in relation to the pivot axis of the yarn mover 5) between stop 7 and cutting device 8 is greater, the free yarn end produced will be accordingly longer, while it becomes shorter with a smaller angular distance.

Appropriate drive and control elements, which can be of conventional design and are, therefore, not shown in the illustrations for the sake of clarity are, of course, provided for the different components described. The drive and control elements are controlled by a control device 96 (see FIG. 3) which also controls the overall piecing process.

Following this description of the device's structure, its operation shall be explained in further detail:

During normal spinning operation, the yarn spun in the conventional manner in the spinning device is fed by means of the pair of draw-off rollers 2 to the bobbin 31 which is driven by the winding roller 30 and is wound on it, whereby the yarn 35 is held at constant tension in the usual manner by yarn tension compensating means (not shown) and is distributed pendulum-fashion by means of a traverse yarn guide (not shown).

If a yarn breakage occurs, the open-end spinning device is stopped in a known manner so that no more fibers reach the fiber collection surface of the open-end spinning element. Furthermore, the bobbin 31 is lifted away from the winding roller 30 through known means which are not shown for that reason, so that the bobbin 31 is also stopped.

To piece the yarn 35 again, the open-end spinning element is cleaned in a known manner and it is, as a rule, temporarily braked for this, possibly until it stops.

In order to be able to feed the end of the broken yarn 35 from the bobbin 31 of the winding device 3 to the fiber collection surface of the open-end spinning element, this end must be drawn off from the bobbin. For that purpose the auxiliary drive drum 340 of the auxiliary drive arrangement 34 is assigned to the bobbin 31 which has been lifted away from the winding roller 30. The auxiliary drive drum 340 is now driven through the usual means (e.g., drive motor 342, see FIG. 3) in a direction opposite to that of normal winding. Furthermore, in time with the advance movement of the auxiliary drive arrangement 34, the suction pipe 4 is pivoted against the bobbin 31 and a negative pressure is produced in it. When a sufficient length of yarn 35 has entered the suction pipe 4 so that it is securely held by the suction air stream prevailing therein, the suction pipe 4 is pivoted away from the bobbin 31, whereby the yarn 35 leaves the suction pipe 4 through its longitudinal slit, but its free end remains held inside the suction pipe 4, as before. As the yarn 35 leaves the suction pipe 4, it goes from the suction pipe 4 to the centering device 41 which is then driven so that the yarn 35 enters its circumferential groove 412. The yarn 35 thus assumes a defined yarn path between the slit end away from the bobbin 31 and the centering device 41.

Figure 2:
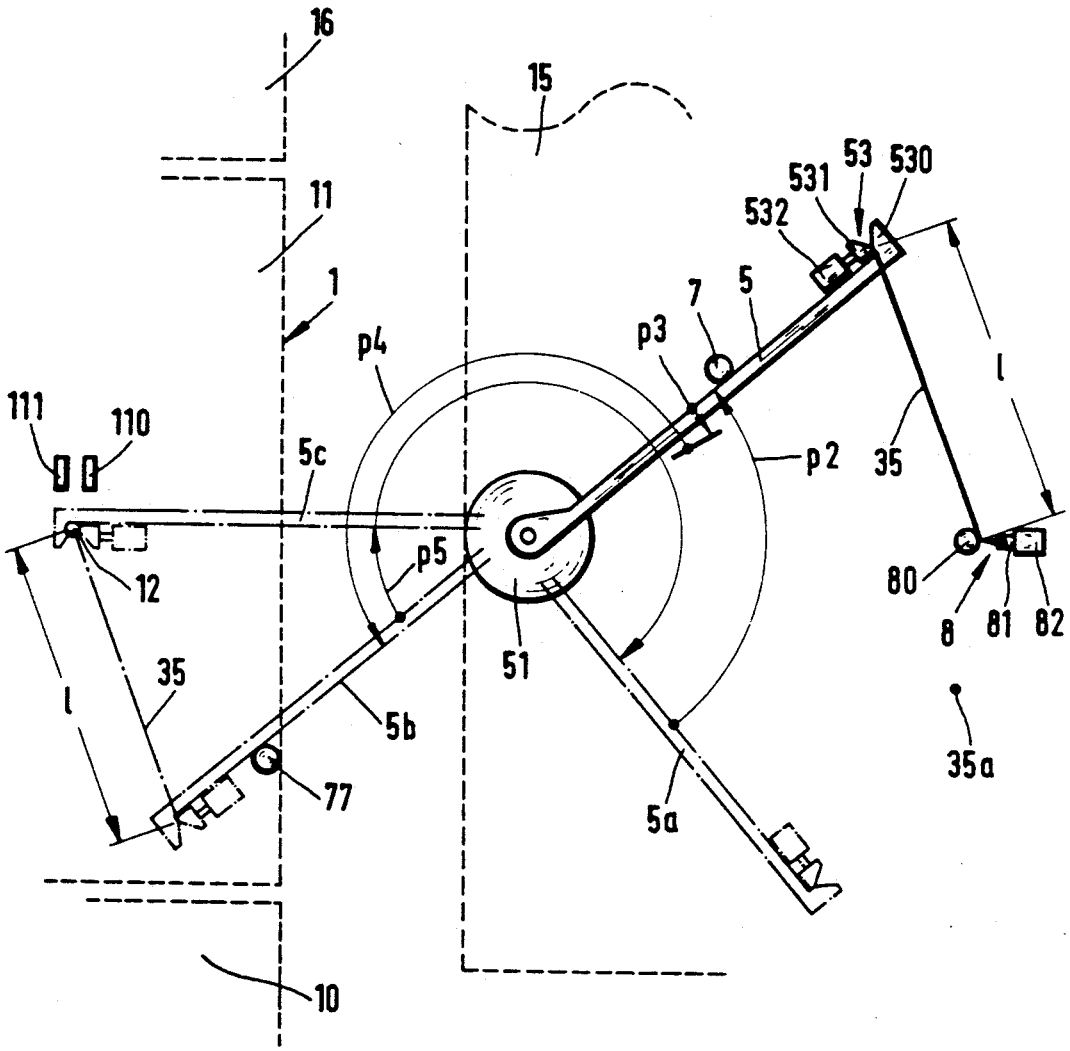
FIG. 2 is a schematic top-view of the device according to the invention in its different work positions.

The yarn mover 5 is at first in a starting position 5*a* (FIG. 2) from which it is pivoted into the position represented in FIG. 2 by a solid line, i.e., its cutting position. At the same time, the yarn clamp 53 passes through the path of the yarn (see yarn 35*a*), seizes and clamps the yarn 35 between its clamping jaws 530 and 531 which can be first opened to seize the yarn 35 and then closed when the yarn 35 has been received. The yarn mover 5 is further pivoted in the direction of the arrow P2 until it runs against the stop 7 and thereby reaches its cutting position. In this movement the yarn 35 extending from the slit end of the suction pipe 4 to the yarn clamp 53 passes the cutting device 8. If the yarn mover 5 has reached its position against stop 7, i.e., its cutting position, the cutting device is actuated and the yarn 35 is severed so that it thus receives a defined yarn length 1 between the yarn clamp 53 and the cutting device 8.

When the yarn 35 has been cut to its defined yarn length 1, the yarn mover 5 must be moved on to the open-end spinning device (see cover 11). For this, the stop 7 is retracted out of the pivoting path of the yarn mover 5. To avoid having to use great drive forces for this, the yarn mover 5 is at first slightly moved from the stop 7 in the direction of the arrow P3 in the embodiment shown in FIG. 2, before stop 7 is pulled out of the path of the yarn mover 5. The yarn mover 5 is then pivoted in direction of arrow P4 to the stop 77 into its yarn insertion position 5*b*, with the yarn clamp 53 being moved across and over the outlet of the yarn draw-off pipe 12.

Two guides 110 and 111 are located before the outlet of the yarn draw-off pipe 12, as seen in relation to the arrow P4. As the yarn mover is moved into its end position 5*b*, the yarn 35 is guided between the two guides 110 and 111, and this ensures that the yarn 35 comes within range of the suction air stream prevailing in the yarn draw-off pipe 12 as a result of the negative spinning pressure.

The position of the stop 77 is determined so that the end of the yarn 35, when the yarn mover 5 is in yarn insertion position 5*b*, is located essentially above the outlet of he yarn draw-off pipe 12 and is sucked into it by the suction air stream prevailing therein. The yarn mover 5 now returns in direction of arrow P5 and stops in the transfer position 5*c* above the yarn draw-off pipe 12. The yarn clamp 53 (FIG. 1) is opened so that the yarn is released by the yarn mover 5. The yarn 35 is now sucked onto the fiber collection surface of the open-end spinning element (not shown) where it comes to lie on the fibers which have been fed in the meantime.

The yarn draw-off is now resumed in a known manner and the yarn 35 is wound up on the bobbin 31 which has been lowered back onto the winding roller 30 in the meantime. By driving the centering device 41 appropriately in the direction opposite to the previous direction of rotation, which was needed to center the yarn 35, yarn 35 is now moved over the length segment 411 to its free end and is thrown off.

Since the yarn 35 follows paths of different lengths in relation to the centering device 41 as it moves from the transfer position (see yarn 35*a*) to the yarn insertion position 5*b* of the yarn mover 5, it is necessary to compensate for these path differences. This is achieved by means of pivoting the centering device in the direction of the double arrow P6 as required, this being done by means of the pivot drive 414.

As shown in FIG. 1, the stop 7 can be adjusted essentially in a path parallel to the pivoting path of the yarn mover 5 (see arrow PI). This adjustability makes it possible to adapt the free yarn end to different sizes of the fiber collection surface. This adjustability of stop 7 makes it further possible to adapt to different fiber materials which differ from each other with respect to staple length of the fibers or to their smoothness or curled state. This shall be explained later in further detail in connection with FIG. 4.

As FIG. 1 clearly shows, the stop 77 is not adjustable in this embodiment. The stop 77 is fixedly set in that case so as to be adapted to the smallest possible size of the fiber collection surface, e.g. to the diameter of a spinning rotor. The fixed setting of the stop 77 thus serves to determine the basic length of the yarn 35 to be fed back into the open-end spinning element.

Figure 3:
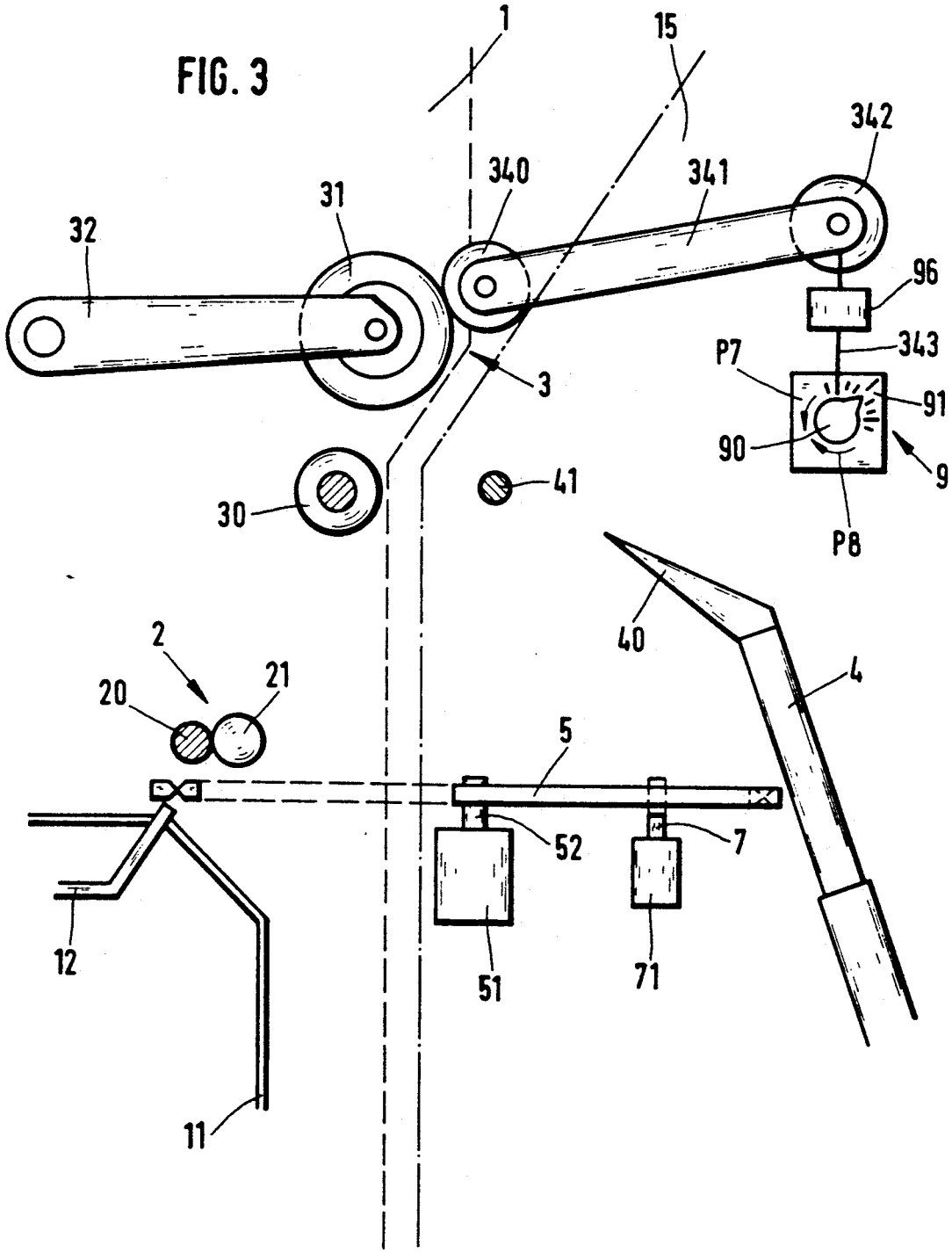
FIG. 3 is a schematic lateral view of an open-end spinning device and of a yarn length adjusting device assigned to the winding device, according to the instant invention.

If greater yarn lengths are required for the back-feeding to the fiber collection surface of the open-end spinning element, the additional yarn length is determined with the help of a yarn length adjusting device 9. In the embodiment shown in FIG. 3, this additional needed yarn length is readied after the insertion of the free end of the yarn 35 into the yarn draw-off pipe 12 through back-feeding of yarn 35, caused by rotating the auxiliary drive drum 340 backwards over a defined distance (circumferential length). For that purpose, as shown in FIG. 3, a drive motor 342 is provided to drive the auxiliary drive drum 340 and is connected in an appropriate manner, e.g. with a transmission belt, to the auxiliary drive drum 340. The drive motor 342 is connected via a control circuit 343 and the earlier-mentioned control device 96 to the yarn length adjustment device 9 which is provided with an adjusting knob 90 and an adjusting scale 91. By rotating the adjusting knob 90 in the direction of arrow P7 or P8, the above-mentioned additional required quantity of back-fed yarn 35 can thus be determined. This adjustment makes it possible for the auxiliary drive drum 340 to be rotated more or less in unwinding direction of the bobbin 31 and an additional yarn length that is correspondingly longer or shorter is thus made available.

In this embodiment the yarn length to be fed back is determined jointly by the stop 77 and the auxiliary drive drum 340, with the determination of this length being effected by the adjustment knob 90 of the yarn length adjusting device.

Instead of back-feeding the yarn 35 from the bobbin 31 to the winding device 3, it is also possible to provide a special piecing bobbin (not shown) from which the yarn 35 to be pieced is unwound. In that case the yarn length adjusting device 9 can be assigned to this piecing bobbin. It is, however, also possible to provide for the back-feeding of the yarn to be effected by means of auxiliary rollers (not shown) which can then be assigned the yarn length adjusting device 9 if necessary.

In the above-mentioned embodiment the position of the first stop, i.e., stop 7, is adjustable and thus determines the basic length of yarn to be fed back to the fiber collection surface of the open-end spinning element for piecing. Beyond this, the adjusting knob 90 of the yarn length adjusting device 9 also serves to set the yarn length to be fed back on the fiber collection surface during the feeding process, so that the adjustable stop 7 is also part of the yarn length adjusting device.

Figure 4:
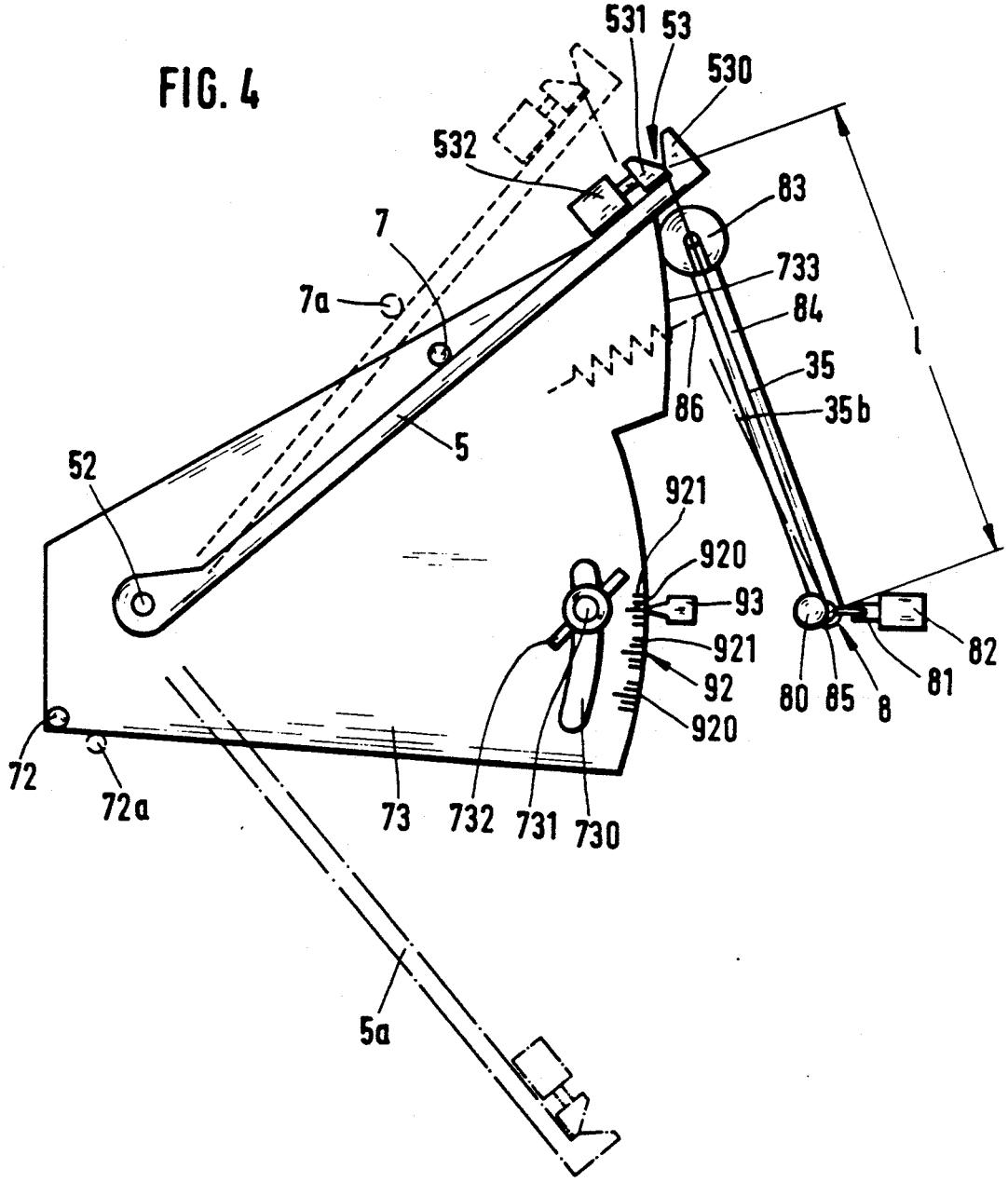
FIG. 4 is a top-view of a variant of the device shown in FIG. 2, combined with a yarn end preparation device.

FIG. 4 shows a variant of the device shown in FIG. 1, in which the two stops 7 and 72 of the yarn mover 5 are supported by a common holding device 73. This holding device 73 is in the shape of a plate.

By means of the holding device 73 it is possible to achieve precise placement of the two stops 7 and 72 in relation to each other. This is especially important if the elements which are merely needed for piecing are not installed at each spinning station, separately for each open-end spinning device, but together for a plurality of adjoining spinning stations of an open-end spinning element on a service unit 15 which is capable of traveling alongside the spinning machine 1 (of which FIG. 2 only shows the covers 10, 11 and 16 of three open-end spinning devices). Thus, the two stops 7 and 72 with their holding device 73, as shown in FIG. 4, but also the yarn mover 5 in its entirety as well as the yarn length adjusting device are installed on this service unit 15, whatever their special design.

In the embodiment shown in FIG. 4, the holding device 73 is part of this yarn length adjusting device and for this reason it is mounted rotatably on the pivot axis 52 of the yarn mover 5, so that both stops 7 and 72 can be adjusted together by adjusting the plate-shaped holding device 73, however without thereby changing the angular distance between the stops 7 and 72. By setting the position of the stop 7 (see position 7*a*) for the cutting position of the yarn mover 5, the position of the stop 72 is also automatically changed for the yarn insertion position of the yarn mover 5 (see position 72*a*). In this manner it is possible to ensure that the distance between the yarn clamp 53 and the cutting device 8 on the one hand, which determines the length of the yarn end, and the yarn clamp 53 and the yarn draw-off pipe 12 (see FIGS. 1 and 2) on the other hand is in all cases always the same.

Since the holding device 73 is not adjusted in a straight line but by rotation, the adjusting slot 730 is curved accordingly. A bolt 731 extends through the adjusting slot 730 and is supported in an appropriate stationary manner. The bolt 731 has threads on its free end on which a wing nut 732 is screwed. After loosening the wing nut 732 it is thus possible to adjust the holding device 73 together with the stops 7 and 72 and to secure it in its adjusted position by then again tightening the wing nut 732.

As FIGS. 1 and 2 show, it is not necessary for the second stop 77 to be adjustable since the differences between the distance between the yarn clamp 53 of the yarn mover 5 in the cutting position and the cutting device 8, on the one hand, and the distance between the yarn clamp 53 of the yarn mover 5 in yarn insertion position 56 and the outlet of the yarn draw-off pipe 12, on the other hand, can be compensated by appropriate control of the bobbin 31 in the unwinding or in the winding direction. This is all the more true when the first stop 7 is connected to the control device 96 (see FIG. 3) in such manner that the applicable position of the stop 7 is scanned and signaled to the control device 96 which then takes into account this position of stop 7 in controlling the auxiliary drive drum 340 (taking into account the setting of the adjusting knob 90).

If the stop 77 is not adjustable it is in the position corresponding to the smallest size of fiber collection surface in the preferred embodiment of the device described, as it would otherwise be necessary to provide a compressed-air nozzle (not shown) for example, attached to the yarn mover 5 and oriented in direction of the arrow P5 which would ensure by its configuration and/or orientation that in its back-feeding movement the free end of the yarn 35 would go from the yarn insertion position 5*b* into its transfer position 5*c* and actually within range of the airstream prevailing within the yarn draw-off pipe 12.

It is, however, not an absolute requirement that the first stop 7 be adjustable, since the yarn length required for piecing is then changed only by setting the adjusting knob 90.

If neither of the stops 7 and 77 is adjustable they are located in a position which corresponds to the smallest size fiber collection surface of the open-end spinning element that may be used. As was already discussed earlier, each additional required yarn length is readied by turning back the winding device 3 or through back-feeding from a special piecing bobbin (not shown), e.g., by means of auxiliary conveying rollers (also not shown).

If the stops 7 and 77 are not set for the smallest size of the possible fiber collection surface but in deviation therefrom, the differences in yarn length required as a result for piecing are compensated through adequate rotation of the bobbin 31, of a special piecing bobbin and/or of special auxiliary conveying rollers in winding or in unwinding direction.

Elements operating on electrostatic principles, friction spinning elements of the most varied forms and purely pneumatic elements can be used as open-end spinning element. IN the latter case the yarn incorporation zone in the air stream is to be understood as being the equivalent of the fiber collection surface.

To be able to make adjustments precisely in adaptation to a given size of the fiber collection surface, e.g., to a given rotor diameter, the holding device 73 is provided with an adjusting scale 92 with which a stationary pointer 93 interacts. The adjusting scale 92 has markings in form of line segments 920 characterizing the different sizes of the fiber collection surface, e.g., rotor diameters. Furthermore, smaller markings in the form of line segments 921 are provided in addition to the line segments 920 in the embodiment shown in FIG. 4 to provide settings for different fiber types, making it possible to deviate from the basic setting determined by the line segments 920 in order to adapt to the different types of fibers.

With normal fiber materials the holding device 73 is adjusted so that the pointer 93 points to a line segment 920 corresponding to the size of the fiber collection surface, e.g., the diameter of the spinning rotor being then used at the open-end spinning element concerned. If the fiber material deviates upward or downward in fiber length or curling tendency from the normal parameters, the holding device 73 is moved from this position which is set for this particular fiber collection surface by one or more line segments 921 in one or the other direction to adapt to the fiber material.

Figure 5:
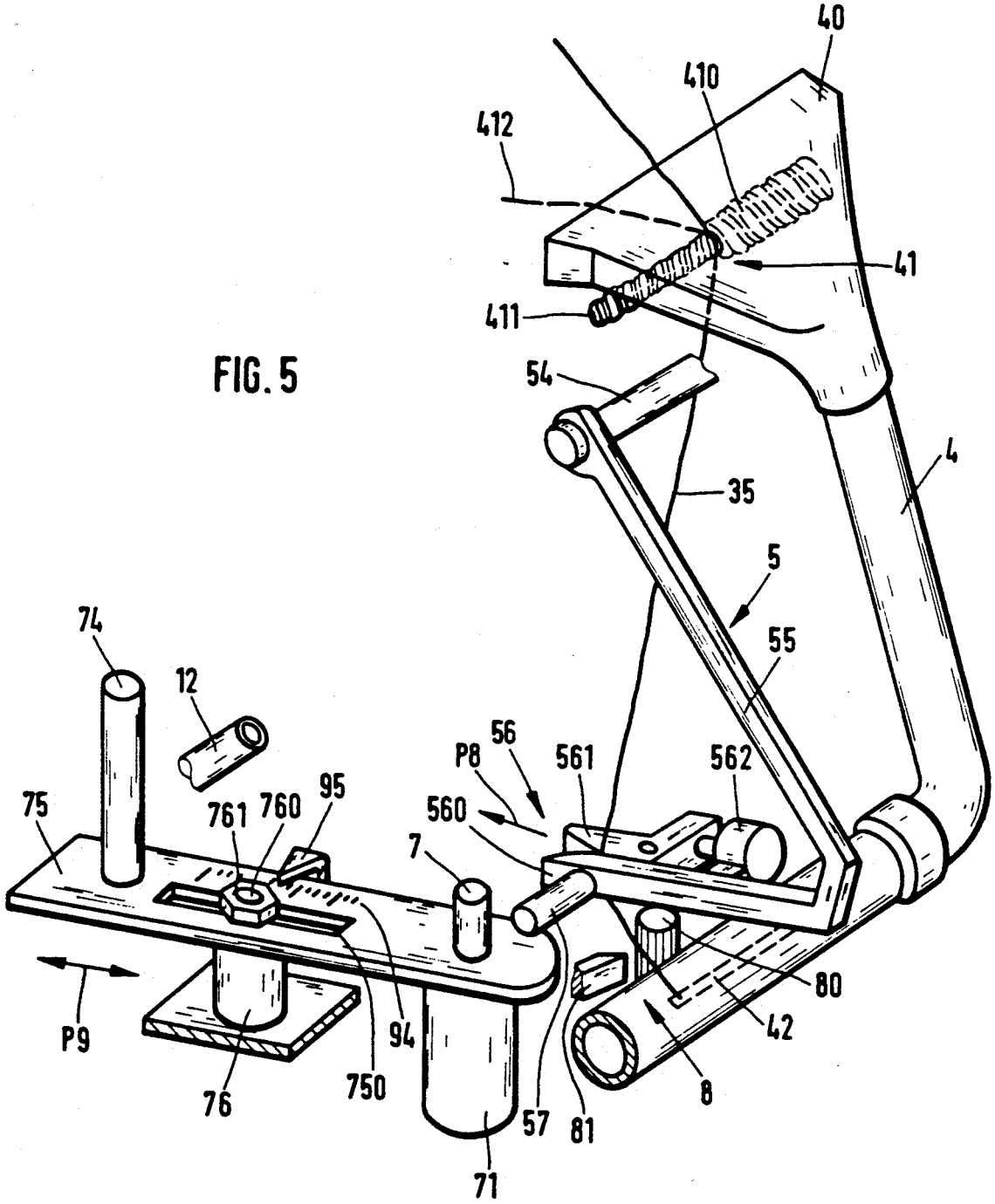
FIG. 5 is a perspective view of an altered embodiment of the device according to the invention.

As shown in FIG. 5, the adjusting scale need not necessarily have different line segments 920 and 921 for the size of the fiber collection surface and for the fiber material. It may suffice to provide a scale without subdivision or merely with instructions concerning either the size of the fiber collection surface or the fiber material.

It is often desirable for the end of yarn 35 to be inserted into the yarn draw-off pipe 12 to be cut not only to a defined length, but also to be tapered in the process. For that purpose a preparation device 83 for the yarn end is provided in the embodiment shown in FIG. 4. THe arrangement in that case is such that the preparation device 83 is located in proximity of the yarn path when the yarn mover 5 bears upon the stop 7. The preparation device 83 according to FIG. 4 is in the path of movement of the yarn mover 5, between the cutting device 8 and the yarn clamp 53 of the yarn mover 5 bearing upon stop 7, i.e., which is in cutting position.

As FIG. 4 shows, the path of the yarn changes when the stop assumes different positions. If the stop 7 is in its position *7a*, for example, the yarn 35 assumes the position 35*b* between the yarn clamp 53 and the cutting device 8. In this position, and with an unchanged position of the preparation device 83, the yarn 35 being held in a straight position would no longer be in the area of the outlet of the preparation device 83. To avoid this disadvantage, provisions are made according to FIG. 4 for the preparation device 83 to be mounted on a pivot arm 84, the pivot axis 85 of which is located near the cutting device 8. The pivot arm 84 with the preparation device 83 is held in elastic application against a bearing curved surface 733 provided on the holding device 73 for the stop 7 by means of a traction spring 86 which is anchored on the one hand in the holding device 73 and on the other hand on the swivel arm 84. This bearing curve 733 is designed so as to cause the preparation device 83 to be brought, through the action of a traction spring 86 always into yarn path corresponding to the position of stop 7 when the holding device 73 is readjusted. This ensures that the end of yarn 35 produced through cutting by means of the cutting device 8 is always above the preparation device 83 so that it can be prepared there in the desired manner.

In principle, the preparation device 83 can be mounted as desired. It is, for example, also possible to install it so as to be capable of sliding in a connecting link which is radial in relation to a pivot axis 52. Since the course of the yarn 35 extending towards the yarn mover 5 depends on the position of the stop 7 when the yarn mover 5 is in its cutting position, bearing against stop 7, the bearing curved surface 733 is connected to the stop 7 (via holding device 73 in the embodiment shown).

The introduction of the yarn into the preparation device 83 can also be effected, at will, by means of a suction air stream taking effect in the preparation device 83, or else by means of a compressed air stream directed against the preparation device 83, with a corresponding compressed air nozzle being possibly provided on the yarn mover 5.

The invention can be varied in many ways, e.g., by replacing individual characteristics by equivalents or through different combinations thereof. Thus, it is not necessary, for example, for the holding device 73 to be provided with an adjusting scale 92, but such an adjusting scale 92 makes it possible to make adjustments especially quickly. It is also possible to provide a digital yarn length adjusting device on the control device 96, which adjusts the holding device 73 and, with it the stops 7 and 72 automatically when the applicable parameters are entered or set.

Through FIG. 1, an embodiment of the yarn mover 5 mounted so as to be capable of pivoting around a pivot axis 52 which is essentially parallel to the more or less vertical course of the yarn, i.e., around a pivot axis 52 which is essentially vertical has been discussed. An especially simple design of the suction pipe 4 is thus possible, and therefore also especially reliable feeding of the yarn 35 to the yarn mover 5. With an embodiment of the suction pipe 4 that is appropriately altered, it is, however, not absolutely necessary for the yarn mover 5 to be pivoted around a vertical axis 52. FIG. 5 shows a variant of the device in which the pivot axis 54 of the yarn mover 5 is positioned horizontally. The yarn mover 5 has an elbowed pivot arm 55 in this embodiment at the free end of which a yarn clamp 56 is located, the yarn clamp being provided with a first clamping jaw 560 which is an integral part of the pivot arm 55, as well as with a second clamping jaw 561 which can be moved towards it and to which a drive 562 is assigned.

The yarn mover 5 can be moved in direction of arrow P8 into its transfer position and into its end position (not shown), and, for that reason, the yarn clamp 56 is made in form of a funnel towards the front, as seen in direction of this movement (arrow P8) and can also be opened to the front.

At its free end the pivot arm 55 is provided with a stop 57 which is applied against the stop 7 when the yarn mover 5 is in cutting position in which the yarn 35 is cut by the cutting device 8.

The stop 7, as well as a stop 74 used to determine the yarn insertion position (see yarn insertion position 5*b* in FIG. 2), are installed on a joint holding device 75 which is an essential part of a yarn length adjusting device. For that purpose the holding device 75 is attached on a stationary holding device 76 in such a manner that the holding device 75 can be moved in the direction of the double arrow P9 in one of the other direction, parallel to the direction of movement (see arrow P8) of the yarn mover 5. For that purpose the holding device 75 is provided with an adjusting slot 750 through which a bolt 760, supported by the holding device 76, extends and on which a nut 761 can be screwed, thus securing the holding device 75 on the holding device 76.

According to FIG. 5, the holding device 75 is equipped again with an adjusting scale 94 with which a stationary pointer 95 interacts. It is thus again possible to set the position of the holding device 75 precisely to meet applicable requirements.

When a yarn breakage occurs, the yarn 35 unwound from the bobbin 31 or from a piecing bobbin enters the suction pipe 4 from which it emerges through a slit 42 when the suction pipe 4 has been pivoted back, whereby the yarn 35 reaches the centering device 41. The end of the slit 42 of the suction pipe 4 is shown by broken lines in FIG. 5. The yarn 35 is now located in a defined yarn path between the end of the slit 42 and the circumferential groove 412 of the centering device 41.

The yarn mover 5 is at first in a starting position (not shown) which is on the right side of the position shown in the drawing of FIG. 5. By moving the yarn mover 5 in the direction of the arrow P8 the yarn 35 comes between the two clamping jaws 560 and 561 of the yarn clamp 56.

The yarn clamps 560 and 561 can be open during reception of the yarn 35 and can be closed after said yarn 35 has been received. However, it is also possible to leave the clamping jaws 560 and 561 in elastic contact with each other even during reception of the yarn 35 if secure reception of the yarn 35 is ensured through appropriate selection of the clamping pressure and through appropriate configuration of the clamping jaws 560 and 561. This, in fact, also applies to the earlier-described yarn clamp 53.

The yarn mover 5 continues its pivoting movement around the pivot axis 54 until its stop 57 comes to bear against the stop 7 which was pre-positioned by means of the holding device 75. This causes the yarn 35 to be brought between the roller 80 and the cutting edge 81 of the cutting device 8. When the yarn mover 5 is in this cutting position the cutting device 8 is actuated so that the yarn end protruding from the yarn clamp 56 is given a length 1 predetermined by means of the holding device 75 by setting the stop 7. When the yarn 35 has been cut to length, the stop 7 is moved out of the path of movement of the yarn mover 5, and especially out of the path of movement of its stop 57, whereby the yarn mover 5 can also be moved slightly in the direction opposite to the direction indicated by arrow P8 if necessary. The yarn mover 5 is then pivoted further in the direction of arrow P8 until its stop 57 comes to bear against the stop 74. The position of stop 74 is set on the holding device 75 in such a manner that when the yarn mover 5 bears against stop 74, i.e., when it is in its yarn insertion position, the yarn end ends above the outlet of the yarn draw-off pipe 12 in this position of the yarn mover 5. Since the stops 7 and 74 are adjusted together, this applies for all the positions of the holding device 75.

The yarn end is now sucked into the yarn draw-off pipe 12, whereby appropriate guide elements can be provided near the outlet of the yarn draw-off pipe 12 (see guides 110 and 111 in FIG. 1). The yarn mover 5 is then moved back until the yarn clamp 56 is located above the outlet of the yarn draw-off pipe 12. By actuating the drive 562 the yarn clamp 56 is opened so that the yarn 35 can be sucked into the yarn draw-off pipe 12. The actual back-feeding for piecing to the fiber collection surface can be effected in the usual manner, e.g., by throwing off the yarn 35 from a previously constituted yarn reserve (not shown). Upon release of the yarn 35 by the yarn clamp 56 the yarn mover 5 returns into its starting position.

When the end of yarn 35 is brought into the area of the outlet of the yarn draw-off pipe 12 by the continued pivoting motion of the yarn mover 5 after cutting and possible preparation, it is important for the yarn 35 to be subjected to a suction air stream of sufficient strength to be held securely. For that purpose the yarn draw-off pipe 12 is equipped with a specially designed outlet piece 13 (see FIG. 6). The outlet piece 13 is provided with a slot 130 extending from the outlet of the yarn draw-off pipe 12 in the direction of arrow P10 whose lateral walls constitute a guide for the yarn 35.

The outlet piece 13 is, furthermore, provided with a sealing surface 131 on which a draw-off pipe cover in form of a cover plate 60 can be laid on its side away from the yarn draw-off pipe 12. The cover plate 60 is part of a pivot arm 6 which is mounted together with the yarn mover 5 on one and the same pivot axle 52. While the pivot arm 50 of the yarn mover 5 is secured axially on the pivot axle 52 in a manner not shown, the pivot arm 6 is mounted on the pivot arm 52 so as to be capable of axial movement. For this purpose a spring support disk 520 is provided (according to FIG. 6) on the upper end of the pivot arm 52. A compression spring 521 acting upon the pivot arm 50, i.e., in the direction of arrow P11 is placed between this spring support disk 520 and the pivot arm 6. The outlet piece is provided with a run-up ramp 132 in the direction indicated by arrow P10, while the pivot arm 6 is equipped with a corresponding run-up slope (not shown) on its leading side (with respect of arrow P10) on its underside towards the outlet piece 13.

The outlet piece 13 is provided on its end, on its trailing side (as seen in relation to arrow P10) with a stop 14 against which the pivot arm 6 is can be brought to bear.

The pivot arm 6 is equipped with a stop 600 on its leading side (as seen in relation to the feeding movement of yarn mover 5 indicated by the arrow P10) by means of which it can be held pressed against the trailing side of the pivot arm 50 of the yarn mover 5. In the embodiment shown, an elastic element, e.g., made in form of a traction spring 61 with one end attached on the pivot arm 50 and the other end on the pivot arm 6, is provided for that purpose.

ON the side of pivot arm 50 away from the pivot arm 6, a drive lever 59 supporting a stop 590 is mounted on the pivot axle 52, with the pivot arm 50 being held pressed against stop 590 by means of an elastic coupling link, e.g., a spring 591, one end of which is attached on the pivot arm 50 and the other end on the drive lever 59. The drive lever 59 thus constitutes a drive arrangement for the yarn mover 5, i.e., for its pivot arm 50.

Furthermore, a drive pinion 592 which is an integral part of the drive lever 59 is mounted on the pivot axle 52. A toothed rack 593, capable of being driven by drive means (not shown) in the direction of the double arrow P12 engages the drive pinion 592.

Figure 6:
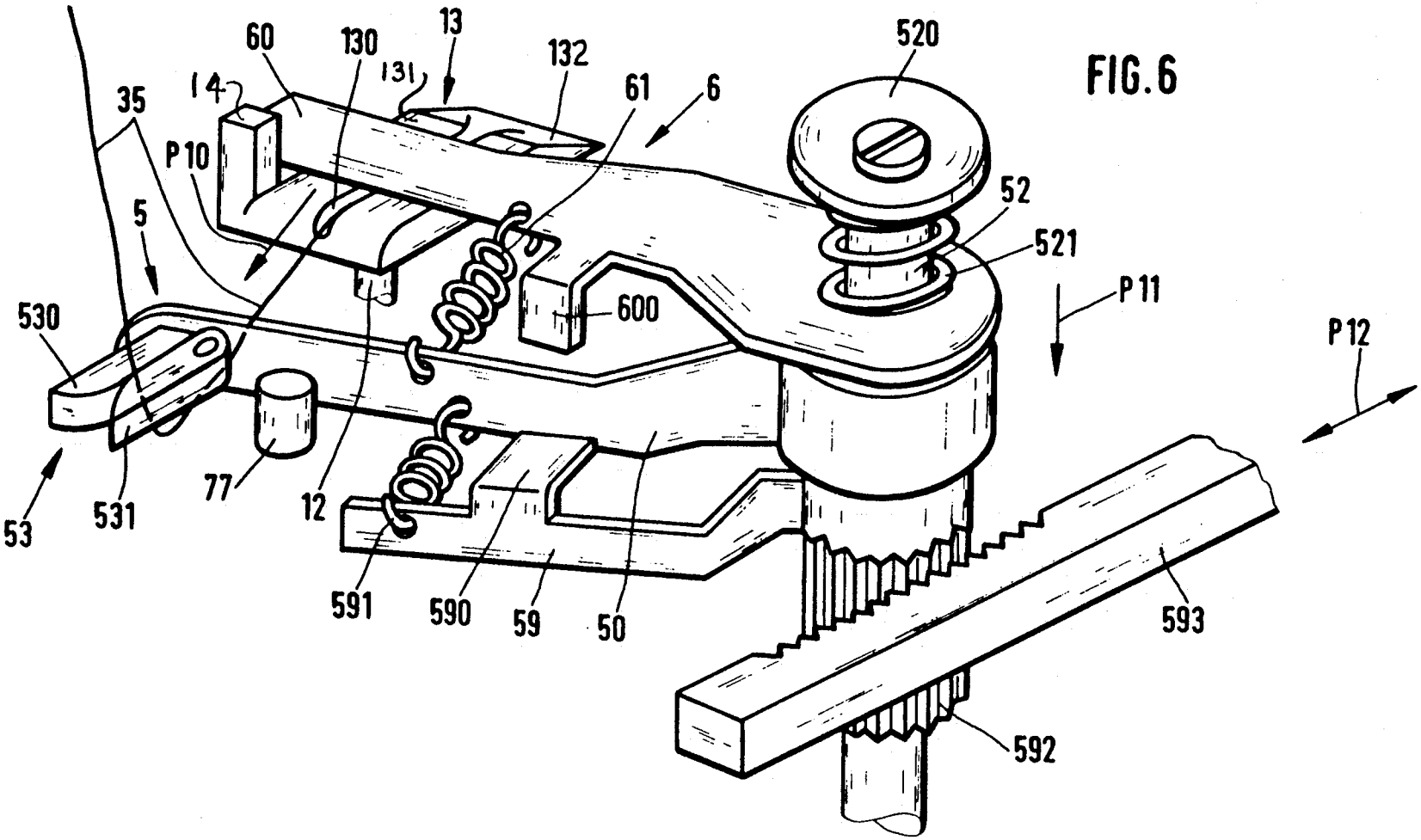
FIG. 6 is a perspective view of a yarn mover according to the instant invention.

In the device shown in FIG. 6, the pivot arm 50 of the yarn mover 5 is not driven directly by the drive lever 59 but via the elastic coupling link (spring 591). At first the pivot arm 50 bears against the stop 590 of the drive lever 59 while the pivot arm 6 is bearing with its stop 600 against a pivot arm 50.

To achieve the defined cutting of the yarn 35 to the desired length the pivot arm 50 is brought to bear against stop 7 (see FIG. 2 and 4). After this cutting and preparation of the yarn 35 the drive lever 59 moves on in the direction of arrow P4 (see FIG. 2). When the pivot arm 60 reaches the run-up ramp 132 of the outlet piece 13 and slides unto the sealing surface 131 of the latter the pivot arm 60 is moved away from the pivot arm 50 against the force of the compression spring 521 in an axial direction contrary to that indicated by arrow P11. When the pivot arm 6 with its cover plate 60 is located above the outlet of the yarn draw-off pipe 12 it is held back in this position as a result of its leading edge running up on the stop 14 facing the yarn mover 5 (pivot arm 50) which continues to move, because this leading edge (leading in relation to the feeding movement of the yarn mover 5) is made in form of a counter-stop for the stop 14.

The drive lever 59 continues its movement and in doing so only slaves the pivot arm 50 since retention is effected by pivot arm 6. Finally the pivot arm 50 reaches stop 77 and is, in turn, held back there, while the drive lever 59 continues its movement for a short distance. The additional movement of the drive lever 59 in relation to the pivot arm 50 is based on the fact that the movement produced by the movement of the toothed rod 593 cannot be adjusted as precisely to the required pivoting path as would be desirable for optimal functioning. For that reason the pivoting motion caused by the toothed rod 593 is set to go further than the maximum pivoting motion needed for the pivot arm 50; for that reason the pivot arm 50 of the yarn mover 5 is, furthermore, not connected rigidly to the drive lever 59 but merely via an elastic coupling link.

When the direction of movement of the toothed rod 593 is reversed, the drive lever 59 comes again to bear with its stop 590 against the pivot arm 50 and moves it in the opposite direction of arrow P10, whereby the end of the yarn 35 is now sucked into the yarn draw-off pipe 12. When the pivot arm 50 runs up against the pivot arm 60 it moves the latter away from stop 14 so that the yarn clamp 53 is able to come precisely above the outlet of the yarn draw-off pipe 12 where the yarn 35 is released for back-feeding to the fiber collection surface of the open-end spinning element.

The yarn 35 is then drawn off in the usual manner and is transferred in a known manner to the winding device 3 (if it is a yarn being drawn off from a piecing bobbin).

The drive of the movable clamping jaw 531 was omitted from FIG. 6 for the sake of clarity.

When the yarn 35 has been released the device shown in FIG. 6 returns to its starting position (see starting position 5*a* in FIGS. 2 and 4).

Figure 7:
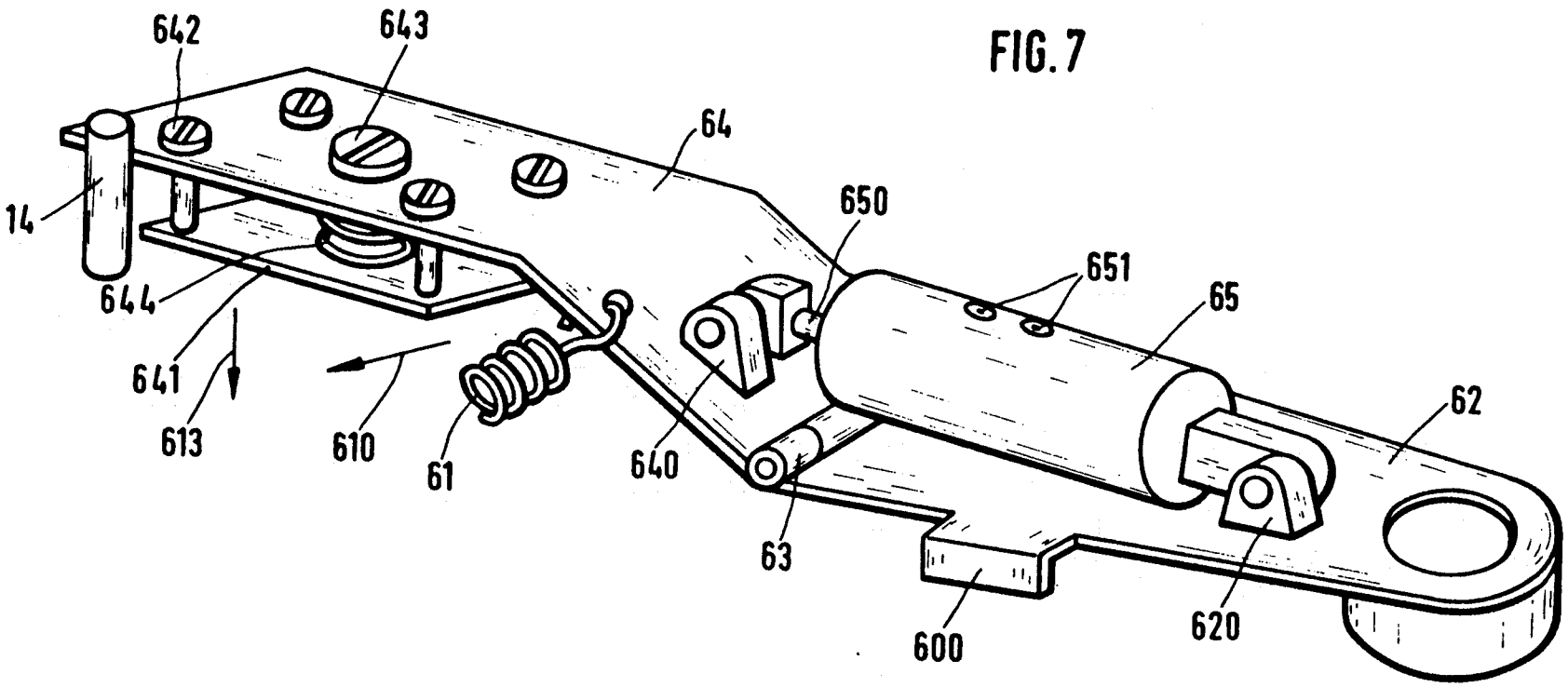
FIG. 7 is a variant of a detail of the yarn mover shown in FIG. 6.

FIG. 7 shows a variant of the pivot arm shown in FIG. 6. In this embodiment a bearing piece 62 in form of a pivot arm is attached in axially secured manner on the pivot axle 52. A cover plate 64, whose leading edge (in relation to the feeding movement of the yarn mover 5) is made as a counter-stop of stop 14, is mounted on the bearing piece 62 via an articulation or hinge 63. To pivot the cover plate 64 in relation to the bearing piece 62 so as to bring the cover plate 64 to bear against the outlet part 13 of the yarn draw-off pipe 12, a controllable drive arrangement (in form of a solenoid 65 in the embodiment shown) is provided and is supported by the bearing piece 62 by means of a bearing 620, the anchor 650 of said driving device being supported by a bearing 640 mounted on the cover plate 64. The solenoid 65 is connected via circuits 651 to a control device (not shown).

It is not necessary for the solenoid 65 to be connected by its two elements to the bearing piece 62 of the cover plate 64. It suffices for the solenoid 65 to be either firmly attached on the bearing piece 62 or on the cover plate 64 and to hold the counter-element constituted by the cover plate 64 or by the bearing piece 62, depending on the placement of the solenoid 65, by means of a spring or similar device constantly pressed against the free end of the anchor 650.

As an alternative to the solenoid 65, it is, of course, possible to provide a different kind of drive, e.g., one which is controlled via a rod system by the action of the cover plate running up against the stop 14 as a result of the run-up movement.

The bearing piece 62, similarly to the pivoting arm 6 shown in FIG. 6, is provided with its own lateral stop 600 by means of which the bearing piece 62 can be held pressed against the pivot arm 50 of the yarn mover 5 which is not shown in FIG. 7. An elastic or elastically mounted sealing plate 641 is provided on the cover plate, on it side towards the (not shown) outlet piece 13.

In the elastically mounted sealing plate 641 shown four threaded bores are provided into which the screws 642 are screwed. The heads of the screws 642 serve as stops and determine the maximum distance between sealing plate 641 and cover plate 64. A fifth screw 643, in the middle between the screws 642, serves as a guide for a compression spring 644 which bears on the one hand against the cover plate 64 and on the other side against the sealing plate 641 and always holds them at a distance from the cover plate 64.

The rigid sealing plate 641, supported by the cover plate 64, does not extend as far forward in the embodiment shown (as seen in relation to the direction of movement indicated by the arrow P10) as does the cover plate 64 which interacts with the stop 14. The cover plate extends beyond the sealing plate 641 in the direction of the leading yarn mover 5 so that the mobility of the sealing plate 641 is not affected, even when the cover plate 64 has run up against the stop 14.

When the yarn mover 5 is moved in direction of arrow P4 (see FIG. 2) into its end position (see 5*b* in FIG. 2), the cover plate 64, with the sealing plate 641, is attracted by the solenoid 65 so that sealing plate 641 does not come into contact with the outlet piece 13 as it carries out this movement. When the cover plate 64 has reached the stop 14 the solenoid 65 is activated, causing the cover plate 64 to be pivoted in direction of arrow P13 and to be brought to bear with its sealing plate 641 against the sealing surface 131 of the outlet piece 13. Thus, no run-up ramp 132, as in case of the outlet piece 13 shown in FIG. 6, is required here.

Because of the elastic mounting of the sealing plate 641, the latter can adapt itself precisely to the sealing surface 131, whereby the heads of the screws 642 stand out from the surface of the cover plate 64 which is visible in FIG. 7.

For this position of the cover plate 64, the end of the yarn 35 is located in the slot 130 of the outlet piece 13, the design of this slot 130 and, of the sealing plate 641, ensuring that the air can only be sucked into the yarn draw-off pipe 12 in the opposite direction to that of arrow P10. When the pivot arm 50 finally returns after having been moved on until it comes to bear against stop 77 (FIGS. 1, 2 and 6), 72 (FIG. 4) or 74 (FIG. 5), the suction air pulls the yarn with it so that the pull exerted on the yarn 35 after the outlet piece 13 has been released by the sealing plate 641 is finally so great that the yarn 35 is securely held in the yarn draw-off pipe 12 even after being released by the yarn clamp 53.

In the embodiment shown the yarn mover 5 is always mounted on a pivoting axle 52 (see FIGS. 1 to 4, 6 and 7) or 54 (see FIG. 5). It is, however, obvious that the yarn mover 5 can also be mounted on a carriage capable of traveling along a straight or curved guiding path.

In the embodiments described through FIGS. 6 and 7 the yarn mover 5 (pivot arm 50) as well as the pivot arm 6 (FIG. 6) or the bearing piece 62 (FIG. 7) are always mounted on a common pivot axle 52. It goes without saying that when the pivot axle 54 is placed horizontally, a corresponding placement of the pivot arm 6 or of the bearing piece 62 (with appropriate design adaptation) on the same pivot axle 54 is also possible, just as a common holding device can also be provided for the two stops 7 and 74.

When the yarn mover 5 can be displaced in a connecting link it is also possible, instead of the pivot arm 6, to provide a piece which can be shifted correspondingly with the cover plate 60 or 64, its movement being coupled until contact is made with a stop corresponding to stop 14.

When a joint holding device 73 or 75 is provided for the two stops 7 and 72 (FIG. 4) or 7 and 74 (FIG. 5), it can be mounted separately from the yarn mover 5. As FIG. 4 shows, an installation of carrier 73 and yarn move 5 on one and the same pivot axle 52 or 54, whether the latter is placed vertically as in FIG. 4 or horizontally as in FIG. 5, is especially advantageous because swivel axle 52 makes it possible to adjust the two stops with particular reliability and precision in this compact and simple design.

In the above-described embodiments, the first stop 7 is pulled away vertically from the essentially horizontal pivoting path of the yarn mover 5 so that the latter may be pivoted into its yarn insertion position 5*b*. Other designs are, of course, also possible. For instance, the first stop 7 can remain unchanged at its place and counter-stop (not shown) installed on the yarn mover 5 can be actuated in order to pull it away from the area of stop 7. It is, furthermore, possible, for example to provide a kind of toothed wheel (not shown) the axis of which is placed at a perpendicular to the path of movement of the yarn mover 5 and whose teeth serve as stops for the yarn mover 5. By stopping the toothed wheel the stop is actuated, while a release of the toothed wheel also releases the yarn mover 5 so that it is able to continue its pivoting motion.

The cutting device 8 functions in the manner of an ax-anvil device in the embodiment shown, but different designs, e.g., in form of scissors, are absolutely possible.

The yarn length compensation as the yarn mover 5 is transferred from its cutting position into its yarn insertion position is carried out in the described embodiment by pivoting the centering device 41, but it goes without saying that an appropriately designed yarn guidance curve can also be provided instead of the pivoting motion.

We claim:

1. An open-end spinning device, comprising:

a) an open-end spinning element for spinning yarn;

b) a winding device for drawing off yarn from said spinning element and for winding said yarn onto a bobbin;

c) a yarn draw-off pipe having inlet and outlet ends interposed between said winding device and said spinning element for guiding yarn;

d) means for supplying a piecing yarn for piecing up broken yarns between said spinning element and said winding device;

e) a yarn mover having means for receiving and holding said piecing yarn, disposed for movement in a path between a piecing yarn receiving position to a position for inserting said piecing yarn in said outlet end of said draw-off pipe for backfeeding said piecing yarn to said spinning element, through an intermediate cutting position;

f) yarn cutting means disposed in a position adjacent to said piecing yarn for cutting said piecing yarn;

g) a first fixed stop disposed in a position adjacent to said yarn mover path and adapted to intercept and interrupt the movement of said yarn mover, after it has received said piecing yarn, at a selected distance from said yarn cutting means;

h) means for adjusting the position of said first fixed stop for adjusting the length of yarn from said yarn mover to said cutting means;

i) means for activating said yarn cutting means after said first stop interrupts the movement of said yarn mover;

j) means for retracting said first stop from said path of said yarn mover and for moving said yarn mover along said path to said yarn insertion position.

k) a second stop disposed in a position adjacent to said yarn mover path and adapted to intercept and interrupt the movement of said yarn mover at a position adjacent to said outlet end of said draw-off pipe;

l) means for creating a negative air pressure in said draw-off pipe to draw said piecing yarn to said spinning element; and m) means for adjusting the length of said piecing yarn fed back to said spinning element.

2. An open-end spinning device as set forth in claim 1, wherein said means for adjusting the length of said piecing yarn comprises an adjusting scale.

3. An open-end spinning device as set forth in claim 2, wherein said adjusting means comprises a scale with markings for different sizes of said open-end spinning element.

4. An open-end spinning device as set forth in claim 2, wherein said adjusting device comprises a scale with markings for different fiber types.

5. A device as set forth in claim 1, wherein said first and second stops are disposed on a common holding device.

6. A device as set forth in claim 5, wherein the position of said common holding device is adjustable to adjust the positions of said first and said second stops.

7. A device as set forth in claim 5, wherein said holding device is pivotally mounted.

8. A device as set forth in claim 1, wherein said mover is resiliently connected to a drive means.

9. A device as set forth in claim 1, wherein said yarn length adjusting device comprises a yarn backfeeding device and is connected to a control means for controlling the length of the yarn fed back to said spinning element.

10. A device as set forth in claim 1, wherein said yarn mover is pivotally mounted on a pivot axis.

11. A device as set forth in claim 10, wherein said pivot axis is substantially parallel to the longitudinal axis of said piecing yarn.

12. A device as set forth in claim 1, wherein said first stop is movable at a right angle to said yarn mover path.

13. A device as set forth in claim 1, further comprising a preparation device for preparing the yarn end disposed in the path of said yarn mover between said cutting device and the cutting position of said yarn mover.

14. A device as set forth in claim 13, further comprising a curved bearing surface disposed in a position where said preparation device is resiliently pressed against said curved surface.

15. A device as set forth in claim 13, wherein said yarn preparation device is mounted in a position to pivot about said cutting device.

16. A device as set forth in claim 11, wherein said yarn mover is resiliently connected to a cover for said draw-off pipe.

17. A device as set forth in claim 16, wherein said draw-off pipe cover comprises a cover plate whose leading edge is adapted to engage said second stop.

18. A device as set forth in claim 16, wherein said pipe cover comprises a bearing piece and a cover plate pivotally mounted thereon.

19. A device as set forth in claim 18, further comprising a controlled drive means for selectively pivoting said cover plate.

20. A device as set forth in claim 19, wherein said drive means comprises a solenoid.

21. A device as set forth in claim 18, wherein a sealing plate is resiliently mounted on said cover plate on its side adjacent said yarn draw-off pipe.

22. A device as set forth in claim 21, wherein said sealing plate is rigid.

23. A device as set forth in claim 21, wherein the leading edge of said cover plate extends beyond the edge of said sealing plate.

24. A device as set forth in claim 16, wherein said draw-off pipe cover sand said yarn mover are pivotally mounted on a common pivot axis.

25. A device as set forth in claim 1, wherein said yarn mover and said first and second stops are disposed on a service unit movable alongside a plurality of open-end spinning devices.

26. An open-end spinning machine having a plurality of open-end spinning devices, each of which comprises: an open-end spinning element for spinning yarns; a winding device for drawing off yarn from said spinning element and for winding said yarn onto a bobbin; a yarn draw-off pipe having inlet end outlet ends interposed between said winding device and said spinning element for guiding said yarn; and means for creating a negative air pressure in said draw-off pipe to draw a piecing yarn into said draw-off pipe and to said spinning element; and a service unit disposed to move alongside said open-end spinning devices, having means for supplying a piecing yarn for piecing up broken yarns between said spinning element and said winding device; a yarn mover having means for receiving and holding said piecing yarn disposed for movement in a path between a piecing yarn receiving position to a position for inserting said piecing yarn into said outlet end of said draw-off pipe for backfeeding said piecing yarn to said spinning element, through an intermediate cutting position; yarn cutting means disposed in a position adjacent to said piecing yarn for cutting said piecing yarn; a first fixed stop disposed in a position adjacent to said yarn mover path and adapted to intercept and interrupt the movement of said yarn mover, after it has received said piecing yarn, at a predetermined distance from said yarn cutting means; means to activate said yarn cutting means after said first stop interrupts the movement of said yarn mover; means for retracting said first stop form said path of said yarn mover and for moving said yarn mover along said path to said yarn insertion position; a second fixed stop disposed in a position adjacent to said yarn mover path and adapted to intercept and interrupt the movement of said yarn mover at a position adjacent to said outlet end of said draw-off pipe; and means for adjusting the length of said piecing yarn fed back to said spinning element.

27. An open-end spinning machine as set forth in claim 26, wherein said piecing yarn is supplied by means for driving said bobbin backward to unwind yarn therefrom.

* * * * *